US006821312B2

(12) United States Patent
Ray et al.

(10) Patent No.: US 6,821,312 B2
(45) Date of Patent: Nov. 23, 2004

(54) CERMET INERT ANODE MATERIALS AND METHOD OF MAKING SAME

(75) Inventors: Siba P. Ray, Murrysville, PA (US); Xinghua Liu, Monroeville, PA (US); Frankie E. Phelps, Apollo, PA (US); Joseph M. Dynys, New Kensington, PA (US); Douglas A. Weirauch, Jr., Murrysville, PA (US)

(73) Assignee: Alcoa Inc., Pittsburgh, PA (US)

( * ) Notice: Subject to any disclaimer, the term of this patent is extended or adjusted under 35 U.S.C. 154(b) by 449 days.

(21) Appl. No.: 10/115,112

(22) Filed: Apr. 1, 2002

(65) Prior Publication Data

US 2002/0153627 A1 Oct. 24, 2002

Related U.S. Application Data

(63) Continuation-in-part of application No. 09/629,332, filed on Aug. 1, 2000, now Pat. No. 6,423,204, which is a continuation-in-part of application No. 09/428,004, filed on Oct. 27, 1999, now Pat. No. 6,162,334, and a continuation-in-part of application No. 09/431,756, filed on Nov. 1, 1999, now Pat. No. 6,217,739, which is a continuation-in-part of application No. 09/241,518, filed on Feb. 1, 1999, now Pat. No. 6,126,799, which is a continuation-in-part of application No. 08/883,061, filed on Jun. 26, 1997, now Pat. No. 5,865,980.

(51) Int. Cl.[7] ..... C22C 29/12

(52) U.S. Cl. ..... 75/233; 75/232; 75/230; 75/228; 204/292; 204/291; 264/6; 264/86; 264/104; 264/681; 501/126; 501/127; 427/126.6; 427/372.2; 427/376.3; 427/427

(58) Field of Search ..... 75/233, 232, 230, 75/228; 204/291, 292; 264/6, 86, 104, 681; 501/126, 127; 427/126.6, 372.2, 376.3, 427

(56) References Cited

U.S. PATENT DOCUMENTS 3,996,117 A 12/1976 Graham et al.

(List continued on next page.)

FOREIGN PATENT DOCUMENTS

WO 99/35694 7/1999
WO 00/44953 11/2000

OTHER PUBLICATIONS

Belyaev, "Electrolysis of Aluminum with Nonburning Ferrite Anodes", *Legkie Metal.*, 7(1), 7–20, 1938.
Billehaug et al., Inert Anodes for Aluminum Electrolysis in Hall–Heroult Cells (I), *Aluminum*, pp. 146–150, 1981.
Billehaug et al., Inert Anodes for Aluminum Electrolysis in Hall–Heroult Cells (II), *Aluminum*, pp. 228–231, 1981.
Ray et al., U.S. patent application Ser. No. 09/629,332, Entitled "Cermet Inert Anode Containing Oxide and Metal Phases Useful for the Electrolytic Production of Metals", Filed Aug. 1, 2000.

*Primary Examiner*—Bruce F. Bell
(74) *Attorney, Agent, or Firm*—Alan G. Towner

(57) ABSTRACT

A method of making cermet inert anodes for the electrolytic production of metals such as aluminum is disclosed. The method includes the step of spray drying a slurry comprising ceramic phase particles and metal phase particles. The resultant spray dried powder, which comprises agglomerates of both the ceramic phase and metal phase particles, may then be consolidated by techniques such as pressing and sintering to produce a cermet inert anode material. The ceramic phase may comprise oxides of Ni, Fe and at least one additional metal selected from Zn, Co, Al, Li, Cu, Ti, V, Cr, Zr, Nb, Ta, W, Mo, Hf and rare earths. The metal phase may comprise Cu, Ag, Pd, Pt, Au, Rh, Ru, Ir and/or Os. The consolidated cermet inert anode material exhibits improved properties such as reduced porosity. The cermet inert anodes may be used in electrolytic reduction cells for the production of commercial purity aluminum as well as other metals.

62 Claims, 7 Drawing Sheets

U.S. PATENT DOCUMENTS 4,190,516 A 2/1980 Kajimaya et al.
4,288,302 A 9/1981 de Nora et al.
4,290,859 A 9/1981 Oda et al.
4,302,321 A 11/1981 de Nora et al.
4,374,050 A 2/1983 Ray
4,374,761 A 2/1983 Ray
4,397,729 A 8/1983 Deruz et al.
4,399,008 A 8/1983 Ray
4,455,211 A 6/1984 Ray et al.
4,462,889 A 7/1984 Landon et al.
4,472,258 A 9/1984 Secrist et al.
4,552,630 A 11/1985 Wheeler et al.
4,582,585 A 4/1986 Ray
4,584,172 A 4/1986 Ray et al.
4,620,905 A 11/1986 Tarcy et al.
4,871,437 A 10/1989 Marschman et al.
4,871,438 A 10/1989 Marschman et al.
4,960,494 A 10/1990 Nguyen et al.
5,019,225 A 5/1991 Darracq et al.
5,137,867 A 8/1992 Ray et al.
5,254,232 A 10/1993 Sadoway
5,279,715 A 1/1994 La Camera et al.
5,284,562 A 2/1994 Beck et al.
5,378,325 A 1/1995 D'Astolfo, Jr. et al.
5,626,914 A 5/1997 Ritland et al.
5,794,112 A 8/1998 Ray et al.
5,865,980 A 2/1999 Ray et al.
5,904,828 A 5/1999 Sekhar et al.
5,938,914 A 8/1999 Dawless et al.
6,030,518 A 2/2000 Dawless et al.
6,077,415 A 6/2000 Duruz et al.
6,113,758 A 9/2000 de Nora et al.
6,126,799 A 10/2000 Ray et al.
6,162,334 A 12/2000 Ray et al.
6,217,739 B1 4/2001 Ray et al.
6,332,969 B1 12/2001 Ray et al.
6,372,119 B1 4/2002 Ray et al.
6,416,649 B1 7/2002 Ray et al.
6,440,279 B1 * 8/2002 De Capite et al. ..... 204/247.3

* cited by examiner

SPRAY-DRIED 777406 POWDER

777406-S3

Edge: Ni 18.43%

Center: Ni 19.74%

Density: 5.70 g/cm$^3$

EC (RT): 12.1±0.9 S/cm

CTE (RT-1000°C): 13.6 µm/m °C

CERMET INERT ANODE MATERIALS AND METHOD OF MAKING SAME

CROSS REFERENCE TO RELATED APPLICATIONS

This application is a continuation-in-part of U.S. Ser. No. 09/629,332 filed Aug. 1, 2000, now U.S. Pat. No. 6,423,204, which is a continuation-in-part of both U.S. Ser. No. 09/428,004 filed Oct. 27, 1999 now U.S. Pat. No. 6,162,334 and U.S. Ser. No. 09/431,756 filed Nov. 1, 1999, now U.S. Pat. No. 6,217,739, both which are continuations-in-part of U.S. Ser. No. 09/241,518 filed Feb. 1, 1999, now U.S. Pat. No. 6,126,799, issued Oct. 3, 2000, which is a continuation-in-part of U.S. Ser. No. 08/883,061 filed Jun. 26, 1997, now U.S. Pat. No. 5,865,980, issued Feb. 2, 1999, all of which are incorporated herein by reference.

FIELD OF THE INVENTION

The present invention relates to cermet inert anodes which are useful for the electrolytic production of metals such as aluminum. More particularly, the invention relates to cermet inert anode materials and spray drying methods for making cermet inert anode materials.

BACKGROUND OF THE INVENTION

The energy and cost efficiency of aluminum smelting can be significantly reduced with the use of inert, non-consumable and dimensionally stable anodes. Replacement of traditional carbon anodes with inert anodes allows a highly productive cell design to be utilized, thereby reducing capital costs. Significant environmental benefits are also possible because inert anodes produce essentially no $CO_2$ or $CF_4$ emissions. Some examples of inert anode compositions are provided in U.S. Pat. Nos. 4,374,050, 4,374,761, 4,399,008, 4,455,211, 4,582,585, 4,584,172, 4,620,905, 5,279,715, 5,794,112, 5,865,980 and 6,126,799, assigned to the assignee of the present application. These patents are incorporated herein by reference.

A significant challenge to the commercialization of inert anode technology is the anode material. Researchers have been searching for suitable inert anode materials since the early years of the Hall-Heroult process. The anode material must satisfy a number of very difficult conditions. For example, the material must not react with or dissolve to any significant extent in the cryolite electrolyte. It must not react with oxygen or corrode in an oxygen-containing atmosphere. It should be thermally stable at temperatures of about 1,000° C. It must be relatively inexpensive and should have good mechanical strength. It must have high electrical conductivity at the smelting cell operating temperatures, e.g., about 900° to 1,000° C., so that the voltage drop at the anode is low.

In addition to the above-noted criteria, aluminum produced with the inert anodes should not be contaminated with constituents of the anode material to any appreciable extent. Although the use of inert anodes in aluminum electrolytic reduction cells has been proposed in the past, the use of such inert anodes has not been put into commercial practice. One reason for this lack of implementation has been the long-standing inability to produce aluminum of commercial grade purity with inert anodes. For example, impurity levels of Fe, Cu and/or Ni have been found to be unacceptably high in aluminum produced with known inert anode materials.

The present invention has been developed in view of the foregoing, and to address other deficiencies of the prior art.

SUMMARY OF THE INVENTION

The present invention relates to cermet inert anode materials which exhibit improved properties such as reduced porosity and the ability to produce commercial purity aluminum when used in an electrolytic aluminum production cell. The inert anode compositions, which are made by a spray drying process, comprise a ceramic phase and a metal phase. The ceramic phase preferably comprises oxides of nickel, iron and at least one other metal selected from Zn, Co, Al, Li, Cu, Ti, V, Cr, Zr, Nb, Ta, W, Mo, Hf and rare earths. The metal phase preferably comprises at least one metal selected from Cu, Ag, Pd, Pt, Au, Rh, Ru, Ir and Os. A preferred metal phase includes Cu and/or Ag, and may also include at least one noble metal selected from Pd, Pt, Au, Rh, Ru, Ir and Os.

An aspect of the present invention is to provide a method of making a cermet inert anode composition. The method includes the steps of providing a slurry comprising ceramic phase particles and metal phase particles, spray drying the slurry to form agglomerated particles comprising the ceramic phase and metal phase particles, and consolidating the spray dried particles to form the cermet inert anode composition comprising the ceramic phase and the metal phase. The ceramic phase may comprise an oxide of Ni, Fe and at least on additional metal selected from Zn, Co, Al, Li, Cu, Ti, V, Cr, Zr, Nb, Ta, W, Mo, Hf and rare earths. The metal phase preferably comprises at least one metal selected from Cu, Ag, Pd, Pt, Au, Rh, Ru, Ir and Os and may be in the form of a substantially pure metal, an alloy of the metal and/or a compound comprising the metal, e.g., CuO, $Cu_2O$, $Ag_2O$, etc.

Another aspect of the present invention is to provide a cermet inert anode composition comprising consolidated spray dried particles including ceramic and metal phases.

A further aspect of the present invention is to provide a method of making a composite powder. The method includes the steps of providing a slurry comprising ceramic phase particles and metal phase particles, and spray drying the slurry to form a powder including agglomerated particles comprising the ceramic phase and metal phase particles. The ceramic phase comprises an oxide of Ni and/or Fe, e.g., an oxide of Ni, Fe and at least one additional metal selected from Zn, Co, Al, Li, Cu, Ti, V, Cr, Zr, Nb, Ta, W, Mo, Hf and rare earths. The metal phase may comprise at least one metal selected from Cu, Ag, Pd, Pt, Au, Rh, Ru, Ir and Os.

Another aspect of the present invention is to provide a composite powder comprising spray dried particles including ceramic phase and metal phase particles.

A further aspect of the present invention is to provide a method of making a green compact of ceramic and metal phase particles. The method includes the steps of providing a slurry comprising ceramic phase particles and metal phase particles, wherein the ceramic phase comprises an oxide of Ni and/or Fe, spray drying the slurry to form agglomerated particles comprising the ceramic phase and metal phase particles, and pressing the spray dried particles to form the green compact.

Another aspect of the present invention is to provide a green compact of ceramic phase and metal phase particles comprising pressed spray dried particles including the ceramic phase and metal phase particles.

Other aspects and advantages of the invention will occur to persons skilled in the art from the following detailed description.

DETAILED DESCRIPTION OF PREFERRED EMBODIMENTS

Figure 1:
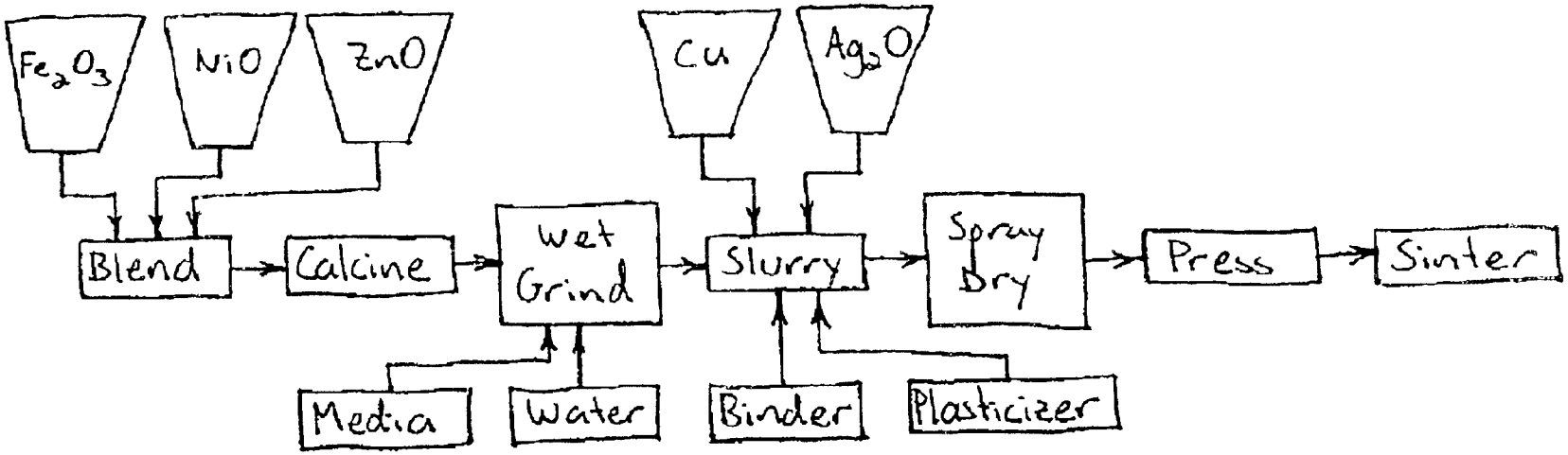
FIG. 1 is a schematic diagram illustrating a process for making a cermet inert anode material including a spray drying step in accordance with an embodiment of the present invention.

FIG. 1 schematically illustrates a spray drying process in accordance with an embodiment of the present invention. Initially, ceramic powders, e.g., $Fe_2O_3$, NiO and ZnO, are blended. Suitable blending techniques include V-blending and Y-blending. Next, the blended ceramic powders are calcined. Calcining temperatures of from about 500° to about 1,250° C. for from about 0.25 to about 6 hours are preferred. The calcination may produce a mixture made from oxide phases, such as nickel and iron oxides in combination with zinc and/or cobalt oxides. If desired, the starting mixture may include other oxide powders such as $Cr_2O_3$ or oxide-forming metals such as Al. After calcining, the ceramic phase particles may be ground, for example, in a ball mill with water and steel ball media. The ground ceramic phase particles may have any desired average particle size, e.g., from about 0.1 to 1 micron or more. An average ground ceramic phase particle size of about 0.25 micron has been found to be satisfactory.

As shown in FIG. 1, a slurry is formed from the ground ceramic phase particles and particles of the metal phase or precursors thereof. The metal phase particles may comprise substantially pure metals and/or alloys thereof, or may comprise oxides of the metal, e.g., Cu (and/or CuO or $Cu_2O$) and Ag (and/or $Ag_2O$). The metal phase particles may have any suitable average particle size, e.g., from about 0.1 to about 20 micron. For example, Cu particles may have an average particle size of from about 10 to about 12 micron, and $Ag_2O$ particles may have an average agglomerated particle size of from about 8 to about 10 micron. The ceramic phase particles and metal phase particles may be blended with a binder, plasticizer and dispersant, along with a solvent such as water, to make a slurry in a spray dryer. The slurry may contain, e.g., about 60 weight percent solids and about 40 weight percent water. Spray drying the slurry produces agglomerated particles comprising both the ceramic phase particles and the metal phase particles.

In a preferred embodiment, the slurry is made by adding from about 0.1 to 10 parts by weight of binders, plasticizers and dispersants to 100 parts by weight of the ceramic and metal phase particles. For example, some suitable organic binders include polyvinyl alcohol (PVA), acrylic polymers, polyglycols, polyvinyl acetate, polyisobutylene, polycarbonates, polystyrene, polyacrylates, and waxes and mixtures and copolymers thereof. Preferably, from about 0.3 to 6 parts by weight of the binder are added to 100 parts by weight of the ceramic phase and metal phase particles. Furthermore, plasticizers such as polyethylene glycol (PEG) and/or dispersion aids such as carboxylic acids may be added to the slurry in amounts of up to about 10 weight percent of the solids content of the slurry. Suitable binder to plasticizer ratios may range from about 1:1 to about 10:1 or higher, preferably about 3:1.

The slurry is then spray dried to form an agglomerated powder comprising the ceramic phase particles and metal phase particles. Thus, the spray dried powder comprises individual particles which include both the ceramic phase particles and metal phase particles. After the spray drying step, the resultant powder is consolidated, for example, by pressing and sintering, as more fully described below.

The term "spray dried powder" as used herein means a substantially free-flowing powder comprising agglomerates of the ceramic phase and metal phase particles. The spray dried powders may be produced by atomization and drying of a slurry. Typical spray drying processes involve the introduction of the slurry into the top of a spray drying chamber through an atomizer. The atomized slurry may be swirled around by hot air circulating in a conical spray drying chamber. The water or other solvent evaporates and the powder typically forms into substantially round agglomerates.

The average particle size of the spray dried powder is typically from about 40 to about 400 micron, preferably from about 50 to about 200 micron. For example, the average particle size may range from about 80 to about 150 micron. A particularly suitable average particle size is about 100 micron. The average particle size of the spray dried powder is typically at least about 4 times greater than the average particle size of both the starting ceramic powder and the starting metal powder, preferably at least about 5 times greater. For example, the average particle size of the spray dried powder may be about 10 times greater than the starting ceramic and metal phase powders.

The spray dried agglomerates of the ceramic phase and metal phase particles are then consolidated. For example, the spray dried powder may be isostatically pressed, e.g., at 10,000 to 40,000 psi, into anode shapes. A pressure of about 20,000 psi is particularly suitable for many applications. To complete the consolidation, the pressed shapes may be sintered in a controlled atmosphere furnace supplied with an argon-oxygen gas mixture, a nitrogen-oxygen gas mixture, or other suitable mixtures. Sintering temperatures of from 1,000 to 1,400° C. may be suitable. For example, the furnace may be operated at 1,350 to 1,385° C. for 2 to 4 hours. The sintering process bums out any polymeric binder from the anode shapes. Alternatively, the ceramic/metal mixture may be consolidated by other techniques such as uniaxial pressing and sintering, hot isostatic pressing, or the like.

The gas supplied during sintering preferably contains from about 5 to 3,000 ppm oxygen, more preferably from about 5 to 700 ppm and most preferably from about 10 to 350 ppm. Lesser concentrations of oxygen may result in a product having a larger metal phase than desired, and excessive oxygen may result in a product having too much of the phase containing metal oxides (ceramic phase). The remainder of the gaseous atmosphere preferably comprises a gas such as argon that is inert to the metal at the reaction temperature. For example, the atmosphere may be predominantly argon, with controlled oxygen contents in the range of 17 to 350 ppm.

After or during consolidation, the spray dried powder may be formed into an inert anode. As used herein, the term "inert anode" means a substantially non-consumable anode which possesses satisfactory corrosion the metal production process, e.g., during the aluminum smelting process. At least part of the inert anode comprises the cermet material of the present invention. For example, the inert anode may be made entirely of the present cermet material, or the inert anode may comprise an outer coating or layer of the cermet material over a central core. Where the cermet is provided as an outer coating, it preferably has a thickness of from about 0.1 to 50 mm, more preferably from about 1 to 10 or 20 mm.

The inert anode compositions of the present invention typically comprise from about 1 to about 99.9 weight percent of the ceramic phase and from about 0.1 to about 99 weight percent of the metal phase. The ceramic phase preferably comprises from about 50 to about 95 weight percent of the cermet material, and the metal phase comprises from about 5 to about 50 weight percent of the cermet. More preferably, the ceramic phase comprises from about 80 to about 90 weight percent of the cermet, and the metal phase comprises from about 10 to about 20 weight percent. It is noted that for every numerical range or limit set forth herein, all numbers within the range or limit including every fraction or decimal between its stated minimum and maximum, are considered to be designated and disclosed by this description.

The ceramic phase preferably comprises iron and nickel oxides, and at least one additional oxide of at least one metal selected from Zn, Co, Al, Li, Cu, Ti, V, Cr, Zr, Nb, Ta, W, Mo, Hf and rare earths, preferably Zn and/or Co.

In a preferred embodiment, the ceramic phase comprises iron, nickel and zinc oxide. In this embodiment, the mole fraction of NiO typically ranges from about 0.2 to about 0.99, the mole fraction of $Fe_2O_3$ typically ranges from about 0.0001 to about 0.8, and the mole fraction of ZnO typically ranges from about 0.0001 to about 0.3. In a preferred composition, the mole fraction of NiO ranges from about 0.45 to about 0.8, the mole fraction of $Fe_2O_3$ ranges from about 0.05 to about 0.499, and the mole fraction of ZnO ranges from about 0.001 to about 0.26. In a more preferred composition, the mole fraction of NiO ranges from about 0.45 to about 0.65, the mole fraction of $Fe_2O_3$ ranges from about 0.2 to about 0.49, and the mole fraction of ZnO ranges from about 0.001 to about 0.22.

Table 1 lists the typical, preferred and more preferred mole fraction ranges of NiO, $Fe_2O_3$ and ZnO. The listed mole fractions may be multiplied by 100 to indicate mole percentages. Within these ranges, the solubility of the constituent oxides in an electrolyte bath is reduced significantly. Lower oxide solubility in the electrolyte bath is believed to improve the purity of the aluminum produced in the bath.

TABLE 1

Mole Fractions of NiO, $Fe_2O_3$ and ZnO

| | NiO | $Fe_2O_3$ | ZnO |
|---|---|---|---|
| Typical | 0.2–0.99 | 0.0001–0.8 | 0.0001–0.3 |
| Preferred | 0.45–0.8 | 0.05–0.499 | 0.001–0.26 |
| More Preferred | 0.45–0.65 | 0.2–0.49 | 0.001–0.22 |

Figure 2:
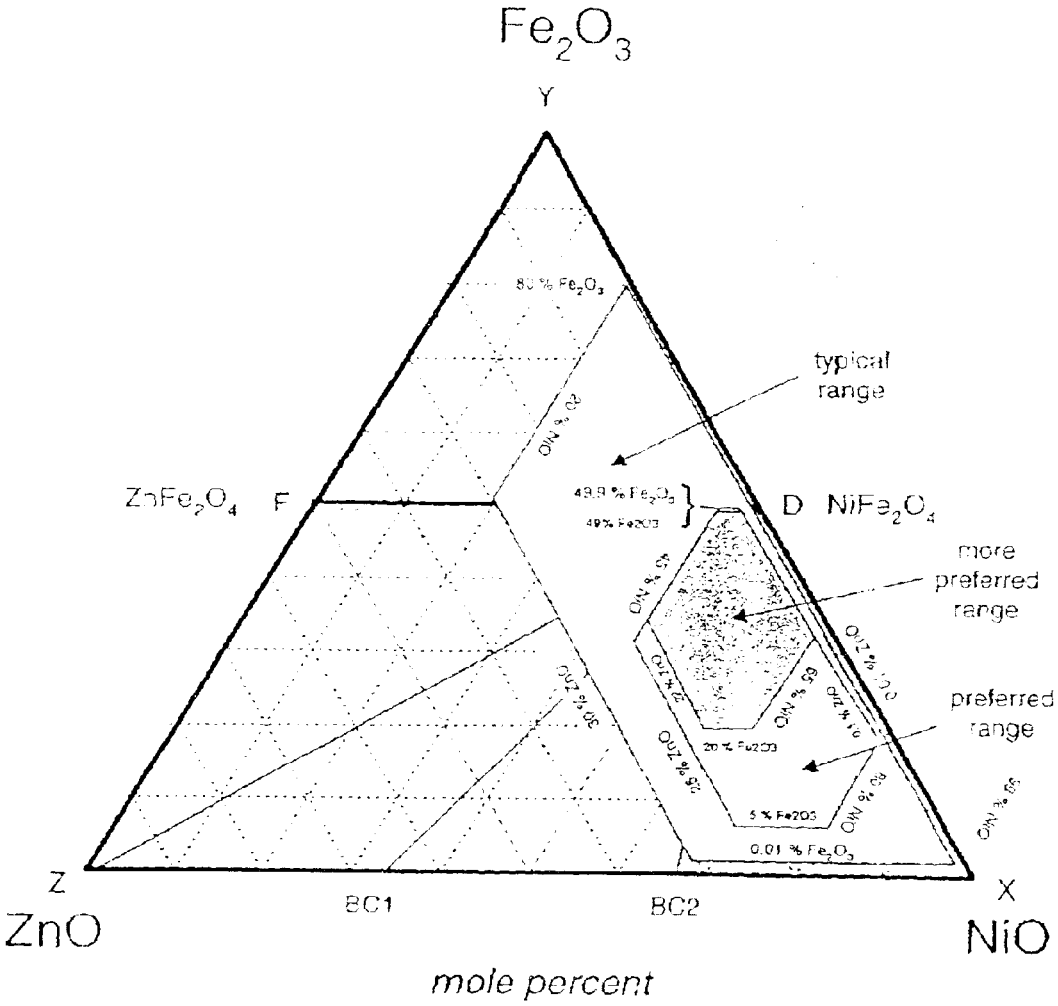
FIG. 2 is a ternary phase diagram illustrating compositional ranges of nickel, iron and zinc oxides used to form inert anode compositions in accordance with an embodiment of the present invention.

FIG. 2 is a ternary phase diagram illustrating the typical, preferred and more preferred ranges of NiO, $Fe_2O_3$ and ZnO starting materials used to make the ceramic phase of the cermet inert anode compositions in accordance with this embodiment of the present invention. Although the mole percentages illustrated in FIG. 2 are based on NiO, $Fe_2O_3$ and ZnO starting materials, other nickel, iron, and zinc oxides, or compounds which form oxides upon calcination, may be used as starting materials.

Table 2 lists some ternary Ni—Fe—Zn—O materials that may be suitable for use as the ceramic phase of the present cermet inert anodes, as well as some comparison materials. In addition to the phases listed in Table 2, other phases may be present.

TABLE 2

Ni—Fe—Zn—O Compositions

| Sample I.D. | Nominal Composition | Measured Elemental wt. % Fe, Ni, Zn | Structural Types (identified by XRD) |
|---|---|---|---|
| 5412 | $NiFe_2O_4$ | 48, 23.0, 0.15 | $NiFe_2O_4$ |
| 5324 | $NiFe_2O_4$ + NiO | 34, 36, 0.06 | $NiFe_2O_4$, NiO |
| E4 | $Zn_{0.05}Ni_{0.95}Fe_2O_4$ | 43, 22, 1.4 | $NiFe_2O_4$ |
| E3 | $Zn_{0.1}Ni_{0.9}Fe_2O_4$ | 43, 20, 2.7 | $NiFe_2O_4$ |
| E2 | $Zn_{0.25}Ni_{0.75}Fe_2O_4$ | 40, 15, 5.9 | $NiFe_2O_4$ |
| E1 | $Zn_{0.25}Ni_{0.75}Fe_{1.9}O_4$ | 45, 18, 7.8 | $NiFe_2O$ |
| E | $Zn_{0.5}Ni_{0.5}Fe_2O_4$ | 45, 12, 13 | $(ZnNi)Fe_2O_4$, $ZnO^S$ |
| F | $ZnFe_2O_4$ | 43, 0.03, 24 | $ZnFe_2O_4$, ZnO |
| H | $Zn_{0.5}NiFe_{1.5}O_4$ | 33, 23, 13 | $(ZnNi)Fe_2O_4$, $NiO^S$ |
| J | $Zn_{0.5}Ni_{1.5}FeO_4$ | 26, 39, 10 | $NiFe_2O_4$, NiO |
| L | $ZnNiFeO_4$ | 22, 23, 27 | $(ZnNi)Fe_2O_4$, $NiO^S$, ZnO |
| ZD6 | $Zn_{0.05}Ni_{1.05}Fe_{1.9}O_4$ | 40, 24, 1.3 | $NiFe_2O_4$ |
| ZD5 | $Zn_{0.1}Ni_{1.1}Fe_{1.8}O_4$ | 29, 18, 2.3 | $NiFe_2O_4$ |
| ZD3 | $Zn_{0.12}Ni_{0.94}Fe_{1.88}O_4$ | 43, 23, 3.2 | $NiFe_2O_4$ |
| ZD1 | $Zn_{0.5}Ni_{0.75}Fe_{1.5}O_4$ | 40, 20, 11 | $(ZnNi)Fe_2O_4$ |
| DH | $Zn_{0.18}Ni_{0.96}Fe_{1.8}O_4$ | 42, 23, 4.9 | $NiFe_2O_4$, NiO |
| DI | $Zn_{0.08}Ni_{1.17}Fe_{1.5}O_4$ | 38, 30, 2.4 | $NiFe_2O_4$, NiO |
| DJ | $Zn_{0.17}Ni_{1.1}Fe_{1.5}O_4$ | 36, 29, 4.8 | $NiFe_2O_4$, NiO |
| BC2 | $Zn_{0.33}Ni_{0.67}O$ | 0.11, 52, 25 | $NiO^S$ |

S means shifted peak.

The compositions listed in Table 2 may be used as the ceramic phase(s) of cermet inert anodes. Such inert anodes may in turn be used to produce commercial purity aluminum in accordance with the present invention.

The Ni—Fe—Zn—O compositions listed in Table 2 may be prepared and tested as follows. Oxide powders may be synthesized by a wet chemical approach or traditional commercial methods. The starting chemicals include one or a mixture of oxides, chlorides, acetates, nitrates, tartarates, citrates and sulfates of Ni, Fe and Zn salts. Such precursors are commercially available from sources such as Aldrich and Fisher. A homogeneous solution may be prepared by dissolving the desired amounts of the chemicals into de-ionized water. The solution pH is adjusted to 6–9 by adding ammonium hydroxide while stirring. A pH of from 7 to 8 is preferred. The viscous solution is dried by oven, freeze dryer, spray dryer or the like. The resultant dried solid is amorphous. Crystalline oxide powders are obtained after calcination of the dried solid, e.g., at a temperature of from 600° to 800° C. for 2 hours.

In another embodiment of the present invention, the ceramic phase of the cermet material comprises iron, nickel and cobalt oxide. In this embodiment, the mole fraction of NiO typically ranges from about 0.15 to about 0.99, the mole fraction of $Fe_2O_3$ typically ranges from about 0.0001 to about 0.85, and the mole fraction of CoO typically ranges from about 0.0001 to about 0.45. In a preferred composition, the mole fraction of NiO ranges from about 0.15 to about 0.6, the mole fraction of $Fe_2O_3$ ranges from about 0.4 to about 0.6, and the mole fraction of CoO ranges from about 0.001 to about 0.25. In more preferred compositions, the mole fraction of NiO ranges from about 0.25 to about 0.55, the mole fraction of $Fe_2O_3$ ranges from about 0.45 to about 0.55, and the mole fraction of CoO ranges from about 0.001 to about 0.2. Table 3 lists the typical, preferred and more preferred mole faction ranges of NiO, $Fe_2O_3$ and CoO. The listed mole fractions may be multiplied by 100 to indicate mole percentages. Within these ranges, the solubility of the constituent oxides in an electrolyte bath is reduced significantly. Lower oxide solubility is believed to improve the purity of the aluminum produced in the bath.

TABLE 3

Mole Fractions of NiO, $Fe_2O_3$ and CoO

| | NiO | $Fe_2O_3$ | CoO |
|---|---|---|---|
| Typical | 0.15–0.99 | 0.0001–0.85 | 0.0001–0.45 |
| Preferred | 0.15–0.6 | 0.4–0.6 | 0.001–0.25 |
| More Preferred | 0.25–0.55 | 0.45–0.55 | 0.001–0.2 |

Figure 3:
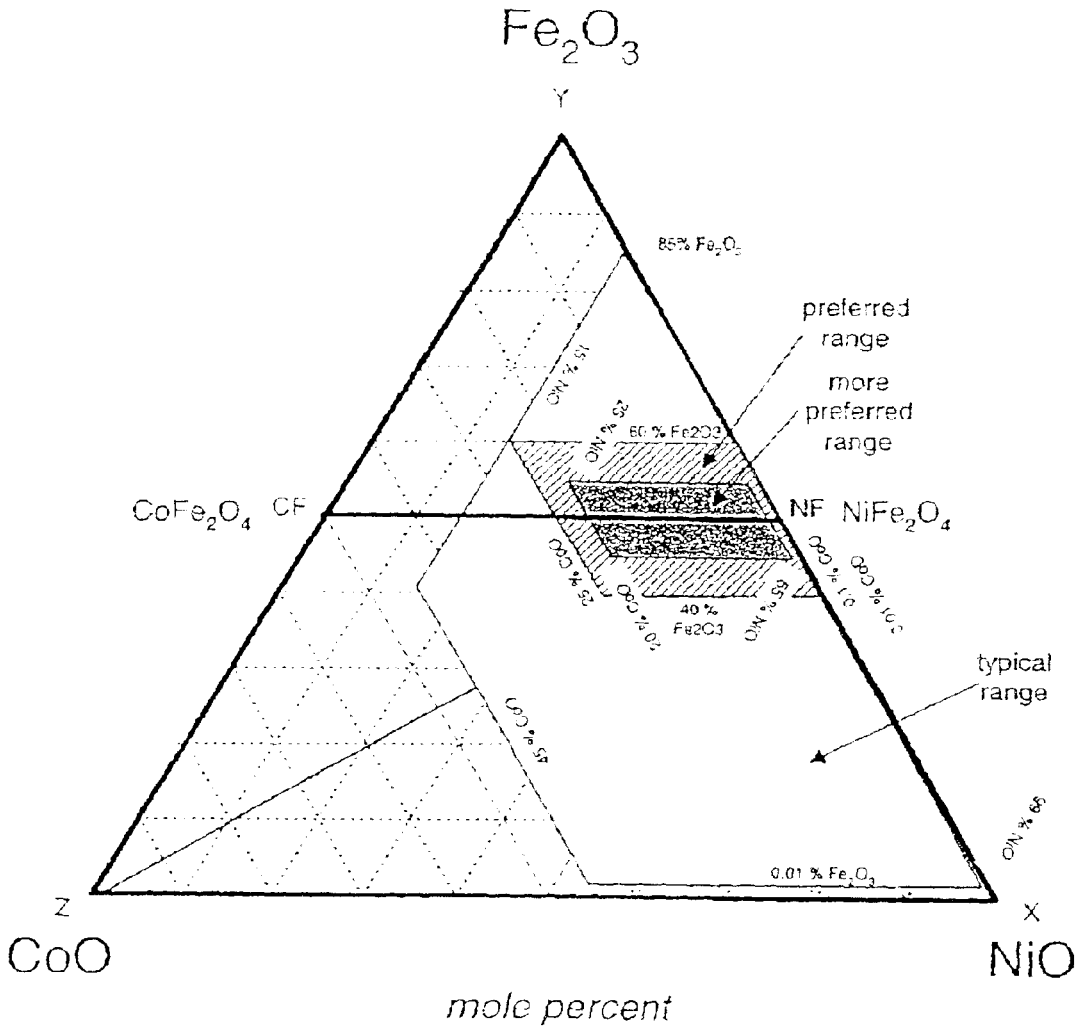
FIG. 3 is a ternary phase diagram illustrating compositional ranges of nickel, iron and cobalt oxides used to form inert anode compositions in accordance with another embodiment of the present invention.

FIG. 3 is a ternary phase diagram illustrating typical, preferred and more preferred ranges of NiO, $Fe_2O_3$ and CoO starting materials used to make the ceramic phase of the cermet inert anode compositions in accordance with this embodiment of the present invention. Although the mole percentages illustrated in FIG. 3 are based on NiO, $Fe_2O_3$ and CoO starting materials, other iron, nickel and cobalt oxides, or compounds which form oxides upon calcination, may be used as starting materials.

Table 4 lists some Ni—Fe—Co—O materials that may be suitable as the ceramic phase of the present cermet inert anodes, as well as Co—Fe—O and Ni—Fe—O comparison materials. In addition to the phases listed in Table 4, other phases may be present.

TABLE 4

Ni—Fe—Co—O Compositions

| Sample I.D. | Nominal Composition | Measured Elemental wt. % Fe, Ni, Co | Structural Types (identified by XRD) |
|---|---|---|---|
| CF | $CoFe_2O_4$ | 44, 0.17, 24 | $CoFe_2O_4$ |
| NCF1 | $Ni_{0.5}Co_{0.5}Fe_2O_4$ | 44, 12, 11 | $NiFe_2O_4$ |
| NCF2 | $Ni_{0.7}Co_{0.3}Fe_2O_4$ | 45, 16, 7.6 | $NiFe_2O_4$ |
| NCF3 | $Ni_{0.7}Co_{0.3}Fe_{1.95}O_4$ | 42, 18, 6.9 | $NiFe_2O_4$ |
| NCF4 | $Ni_{0.85}Co_{0.15}Fe_{1.95}O_4$ | 44, 20, 3.4 | $NiFe_2O_4$ |
| NCF5 | $Ni_{0.80}Co_{0.3}Fe_{1.9}O_4$ | 45, 20, 7.0 | $NiFe_2O_4$, NiO |
| NF | $NiFe_2O_4$ | 48, 23, 0 | N/A |

The compositions listed in Table 4 may be used as the ceramic phase(s) of cermet inert anodes. Such inert anodes may in turn be used to produce commercial purity aluminum in accordance with an embodiment of the present invention.

In addition to the above-noted ceramic phase materials, the cermet inert anodes of the present invention include at least one metal phase. The metal phase may be continuous or discontinuous, and preferably comprises a base metal and at least one noble metal. When the metal phase is continuous, it forms an interconnected network or skeleton which may substantially increase electrical conductivity of the cermet anode. When the metal phase is discontinuous, discrete particles of the metal are at least partially surrounded by the ceramic phase(s), which may increase corrosion resistance of the cermet anode.

Copper and silver are preferred base metals of the metal phase. However, other metals may optionally be used to replace all or part of the copper or silver. Furthermore, additional metals such as Co, Ni, Fe, Al, Sn, Nb, Ta, Cr, Mo, W and the like may be alloyed with the base metal of the metal phase. Such base metals may be provided from individual or alloyed powders of the metals, or as oxides or other compounds of such metals, e.g., CuO, $Cu_2O$, $Ag_2O$, etc.

The noble metal of the metal phase preferably comprises at least one metal selected from Ag, Pd, Pt, Au, Rh, Ru, Ir and Os. More preferably, the noble metal comprises Ag, Pd, Pt, Ag and/or Rh. Most preferably, the noble metal comprises Ag, Pd or a combination thereof. The noble metal may be provided from individual or alloyed powders of the metals, or as oxides or other compounds of such metals, e.g., silver oxide, palladium oxide, etc.

In a preferred embodiment, the metal phase typically comprises from about 50 to about 99.99 weight percent of the base metal, and from about 0.01 to about 50 weight percent of the noble metal(s). Preferably, the metal phase comprises from about 70 to about 99.95 weight percent of the base metal, and from about 0.05 to about 30 weight percent of the noble metal(s). More preferably, the metal phase comprises from about 90 to about 99.9 weight percent of the base metal, and from about 0.1 to about 10 weight percent of the noble metal(s).

The types and amounts of base and noble metals contained in the metal phase of the inert anode are selected in order to substantially prevent unwanted corrosion, dissolution or reaction of the inert anodes, and to withstand the high temperatures which the inert anodes are subjected to during the electrolytic metal reduction process. For example, in the electrolytic production of aluminum, the production cell typically operates at sustained smelting temperatures above 800° C., usually at temperatures of 900° to 980° C. Accordingly, inert anodes used in such cells should preferably have metal phase melting points above 800° C., more preferably above 900° C., and optimally above about 1,000° C.

In one embodiment of the invention, the metal phase of the anode comprises copper as the base metal and a relatively small amount of silver as the noble metal. In this embodiment, the silver content is preferably less than about 10 or 15 weight percent. For example, the Ag may comprise from about 0.2 to about 9 weight percent, or may comprise from about 0.5 to about 8 weight percent, remainder copper. By combining such relatively small amounts of Ag with such relatively large amounts of Cu, the melting point of the Cu—Ag alloy phase is significantly increased. For example, an alloy comprising 95 weight percent Cu and 5 weight percent Ag has a melting point of approximately 1,000° C., while an alloy comprising 90 weight percent Cu and 10 weight percent Ag forms a eutectic having a melting point of approximately 780° C. This difference in melting points is particularly significant where the alloys are to be used as part of inert anodes in electrolytic aluminum reduction cells, which typically operate at smelting temperatures of greater than 800° C.

In another embodiment of the invention, the metal phase comprises copper as the base metal and a relatively small amount of palladium as the noble metal. In this embodiment, the Pd content is preferably less than about 20 weight percent, more preferably from about 0.1 to about 10 weight percent.

In a further embodiment of the invention, the metal phase comprises silver as the base metal and a relatively small amount of palladium as the noble metal. In this embodiment, the Pd content is preferably less than about 50 weight percent, more preferably from about 0.05 to about 30 weight percent, and optimally from about 0.1 to about 20 weight percent. Alternatively, silver may be used alone as the metal phase of the anode.

In another embodiment of the invention, the metal phase of the anode comprises Cu, Ag and Pd. In this embodiment, the amounts of Cu, Ag and Pd are preferably selected in order to provide an alloy having a melting point above 800° C., more preferably above 900° C., and optimally above about 1,000° C. The silver content is preferably from about 0.5 to about 30 weight percent of the metal phase, while the Pd content is preferably from about 0.01 to about 10 weight percent. More preferably, the Ag content is from about 1 to about 20 weight percent of the metal phase, and the Pd content is from about 0.1 to about 10 weight percent. The weight ratio of Ag to Pd is preferably from about 2:1 to about 100:1, more preferably from about 5:1 to about 20:1.

In accordance with one embodiment of the present invention, the types and amounts of base and noble metals contained in the metal phase are selected such that the resultant material forms at least one alloy phase having an increased melting point above the eutectic melting point of the particular alloy system. For example, as discussed above in connection with the binary Cu—Ag alloy system, the amount of the Ag addition may be controlled in order to substantially increase the melting point above the eutectic melting point of the Cu—Ag alloy. Other noble metals, such as Pd and the like, may be added to the binary Cu—Ag alloy system in controlled amounts in order to produce alloys having melting points above the eutectic melting points of the alloy systems. Thus, binary, ternary, quaternary, etc. alloys may be produced in accordance with the present invention having sufficiently high melting points for use as part of cermet inert anodes in electrolytic metal production cells.

Spray-dried powders of the present invention may be made using the following steps. Individual oxide powders are measured out in accordance with the desired formula, then blended to a homogeneous state by dry mixing. Small amounts of water are then added to the mixer to pelletize or create larger units of blended powder that are easier to handle. The pelletized blended powders are calcined or heat-treated to cause the individual oxide powders to react to form ferrite phases. Heat treatments are done in air at temperatures ranging from 1,000 to 1,170° C. for periods of about 30 minutes to 4 hours. Various furnace configurations may be used, including indirectly heated rotary kilns, batch kilns and tunnel kilns. The calcined pellets are ground to the desired particle size, e.g., by ball milling in water. The water/powder suspension is then transferred from the ball mill to a mixing tank. At this point, binder, plasticizer and metal phase powders, e.g., copper and silver oxide powders, are added to the slurry while it is continuously mixed. Typically, 30 to 60 minutes mixing time may be used to fully disperse and homogenize the slurry blend.

The mixture is then fed into a standard spray dryer system. The water in the slurry is removed by spraying the slurry mixture into a continuously heated chamber. Various configurations of dryers and atomization methods may be used to produce the powders, including two fluid nozzle systems and rotary disc atomizer systems. Dryer sizes ranging from bench top units to larger units roughly 20 feet in diameter may be used.

Powders made by this method comprise agglomerates of the ceramic and metal phase particles, and typically exhibit average particle sizes in the range of 40 to 120 microns, with bulk densities in the range of 1.3 to 1.6 gram/cubic centimeter. The spray dried powders possess favorable properties such as uniform composition, stable composition with handling (composition does not segregate), good flow (uniformly fills dies or molds at dry pressing), and green strength sufficient for pressing, handling and machining of parts. Useful shapes may be fabricated from these powders by dry pressing methods including uniaxial compaction in steel dies and cold isostatic compaction using various standard mold materials.

Figure 4A:
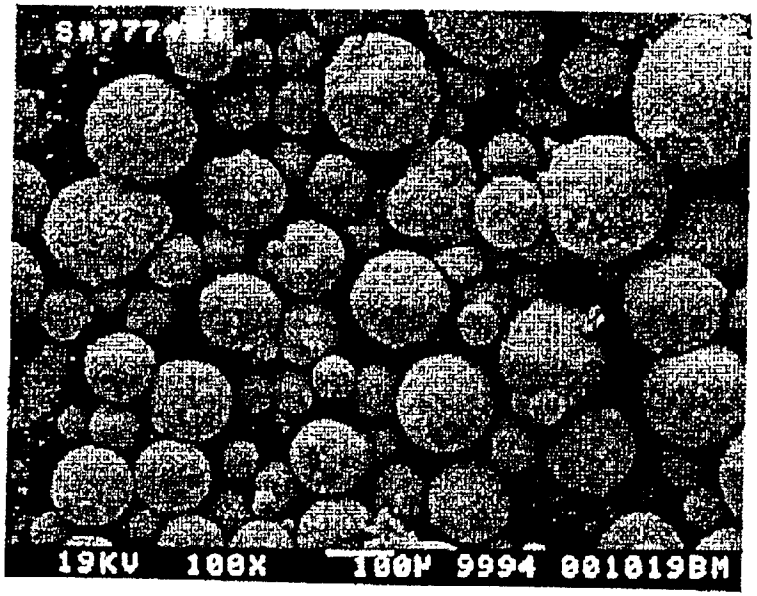
FIGS. 4*a* and 4*b* are micrographs of a spray dried composite powder in accordance with an embodiment of the present invention.
Figure 4B:
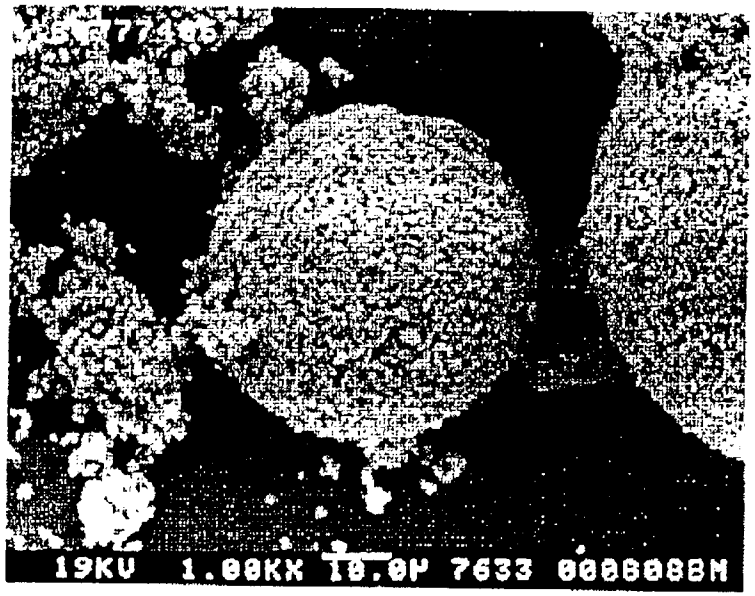

FIGS. 4*a* and 4*b* are micrographs showing an agglomerated ceramic/metal spray dried powder made by the process described above at magnifications of 100× and 1000×, respectively. The powder corresponds to Sample No. 777406, having the composition listed in Table 5.

In addition to the powder shown in FIGS. 4*a* and 4*b*, other spray dried powders were formed using similar techniques. The additional powders have compositions as shown in Table 5.

TABLE 5

Compositions of the Spray-dried Powders

| | Composition | | | | | Binder | | |
|---|---|---|---|---|---|---|---|---|
| Sample No. | NiO (wt %) | ZnO (wt %) | $Fe_2O_3$ (wt %) | Cu (wt %) | $Ag_20$ (wt %) | Dispex (wt %) | Binder/ Plasticizer | Wt % Organics |
| 777403 | 27.91 | 1.73 | 56.65 | 12 | 1.71 | 0.4 | 10 | 1.53 |
| 777404 | 27.91 | 1.73 | 56.65 | 12 | 1.71 | 0.4 | 10 | 1.73 |
| 777405 | 27.91 | 1.73 | 56.65 | 12 | 1.71 | 0.4 | 6 | 1.73 |
| 777406 | 27.91 | 1.73 | 56.65 | 12 | 1.71 | 0.4 | 3 | 1.73 |
| 777407 | 27.91 | 1.73 | 56.65 | 12 | 1.71 | 0.4 | 6 | 2.17 |
| 777408 | 27.91 | 1.73 | 56.65 | 12 | 1.71 | 0.4 | 6 | 1.14 |
| 777444 | 27.91 | 1.73 | 56.65 | 12 | 1.71 | 0.4 | 6 | 1.73 |
| 777445 | 27.91 | 1.73 | 56.65 | 12 | 1.71 | 0.4 | 3 | 1.38 |
| 777446 | 27.91 | 1.73 | 56.65 | 12 | 1.71 | 0.4 | 2 | 1.73 |

TABLE 5-continued

| Compositions of the Spray-dried Powders | | | | | | | | |
|---|---|---|---|---|---|---|---|---|
| | Composition | | | | | Binder | | |
| Sample No. | NiO (wt %) | ZnO (wt %) | $Fe_2O_3$ (wt %) | Cu (wt %) | $Ag_20$ (wt %) | Dispex (wt %) | Binder/ Plasticizer | Wt % Organics |
| 787840 | 30.30 | 1.89 | 61.90 | 5 | 0.71 | 0.4 | 3 | 1.50 |
| 787841 | 32.35 | 2.00 | 65.65 | 0 | 0.00 | 0.4 | 3 | 1.50 |
| 787842 | 27.91 | 1.73 | 56.65 | 12 | 1.71 | 0.4 | 3 | 1.50 |
| 787913 | 30.62 | 1.89 | 62.13 | 5 | 0.36 | 0.4 | 3 | 1.50 |
| 787914 | 29.58 | 1.83 | 60.02 | 8 | 0.57 | 0.4 | 3 | 1.50 |
| 787953 | 28.19 | 1.74 | 57.21 | 12 | 0.86 | 0.4 | 3 | 1.50 |

Table 6 lists the bulk density, tap density, flowability and average particle size of the spray dried powder samples listed in Table 5.

TABLE 6

| Properties of the Spray-dried Powders | | | | |
|---|---|---|---|---|
| | Powder Properties | | | |
| Sample No. | D50 (um) | Bulk density (g/cc) | Tap density (g/cc) | Flow (second) |
| 777403 | 120 | 1.21 | 1.38 | 62.26 |
| 777404 | 134 | 1.32 | 1.52 | 56.42 |
| 777405 | 120 | 1.32 | 1.49 | 55.16 |
| 777406 | 122 | 1.31 | 1.49 | 54.57 |
| 777407 | 150 | 1.19 | 1.38 | 66.23 |
| 777408 | 118 | 1.30 | 1.47 | 51.26 |
| 777444 | 118 | 1.37 | 1.47 | 49.9 |
| 777445 | 112 | 1.41 | 1.56 | 45.55 |
| 777446 | 123 | 1.46 | 1.57 | 46.13 |
| 787840 | 103.1 | 1.46 | 1.65 | 44 |

Table 7 lists the particle size distributions of some of the spray dried powder samples.

TABLE 7

| Spray Dried Powder Particle Size | | | | | | |
|---|---|---|---|---|---|---|
| Sieve Analysis | Sample No. | | | | | |
| Mesh Size | 777403 | 777404 | 777405 | 777406 | 777407 | 777408 |
| 80 | 28.37 | 11.87 | 12.11 | 9.54 | 27.40 | 4.72 |
| 100 | 17.39 | 16.40 | 17.89 | 14.43 | 19.05 | 7.98 |
| 120 | 18.49 | 23.20 | 24.14 | 21.49 | 19.02 | 15.73 |
| 170 | 20.13 | 29.17 | 26.60 | 29.07 | 19.68 | 29.12 |
| 200 | 6.26 | 8.43 | 7.44 | 9.65 | 5.85 | 12.7 |
| 270 | 6.65 | 7.36 | 7.74 | 10.23 | 5.83 | 17.59 |
| 325 | 1.34 | 1.17 | 1.67 | 2.22 | 1.00 | 5.04 |
| pan | 1.14 | 0.91 | 1.36 | 2.13 | 0.72 | 6.63 |

In order to illustrate the difference between the spray dried powder of the present invention and similar powders which have not undergone the spray drying process, the different types of powders were pressed to form green compacts, fractured in their unfired states, and their fracture surfaces were observed.

Figure 5A:
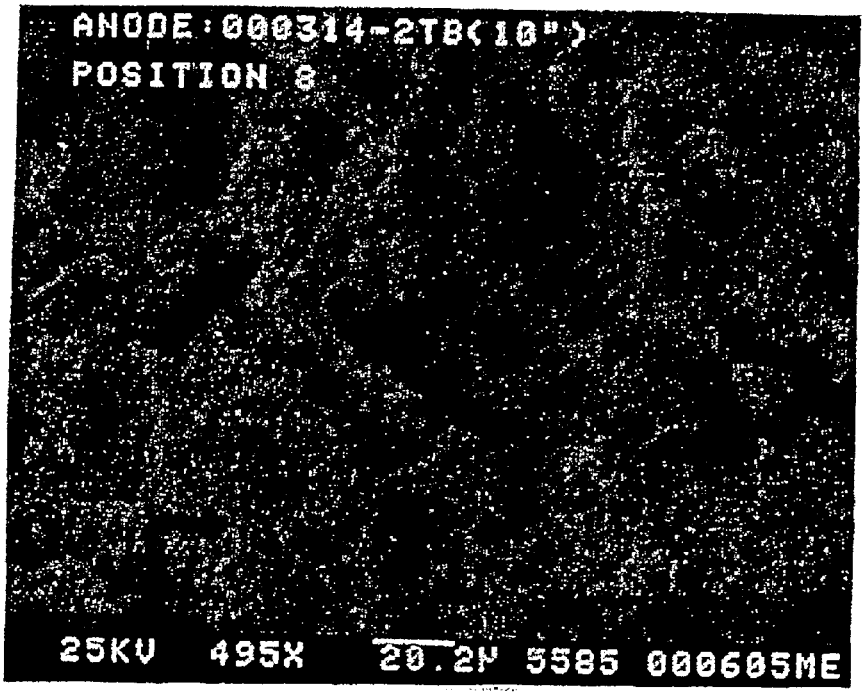
FIG. 5*a* is a micrograph showing the fracture surface of an unfired, dry-blended cermet produced without the spray drying process of the present invention.

FIG. 5*a* is a micrograph of the fracture surface of a dry-blended (non-spray dried), pressed unfired sample having a powder composition of 56.65 weight percent $Fe_2O_3$; 27.91 weight percent NiO; 1.73 weight percent ZnO; 12 weight percent Cu; and 1.71 weight percent $Ag_2O$. The dry-blended powder was made by V-blending the composition, followed by pressing at 2,000 psi.

Figure 5B:
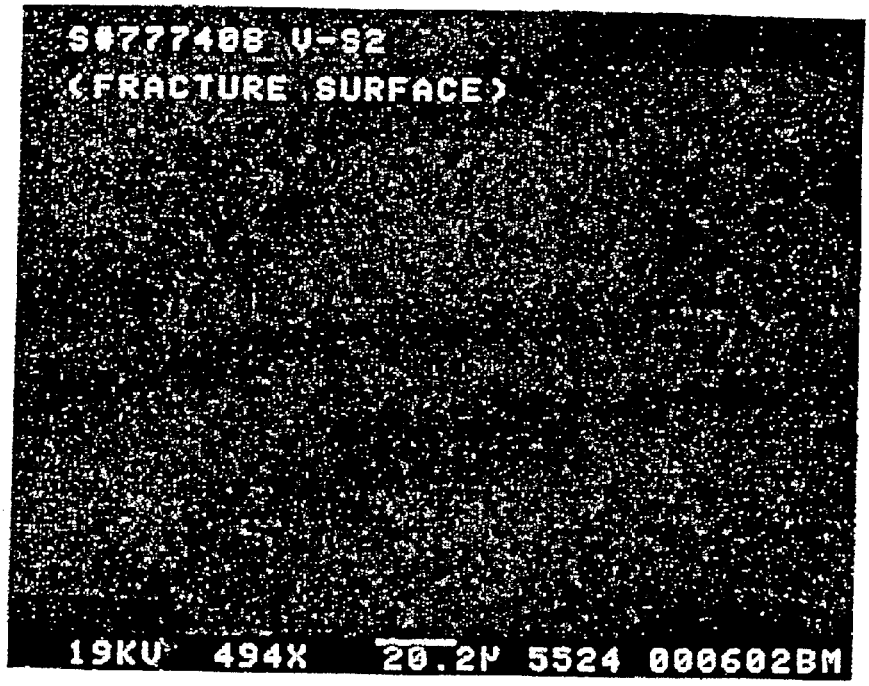
FIG. 5*b* is a micrograph showing the fracture surface of an unfired, spray dried cermet produced in accordance with an embodiment of the present invention.

FIG. 5*b* is a micrograph of the fracture surface of a spray dried, pressed unfired sample in accordance with an embodiment of the present invention. The sample of FIG. 5*b* has a composition corresponding to Sample No. 777408 in Table 5, and was made by the spray drying process described above.

By comparing FIGS. 5*a* and 5*b*, it can be seen that the fracture surface of the spray dried sample made in accordance with the present invention (FIG. 5*b*) is more uniform with substantially smaller intergranular pores in comparison with the fracture surface of the sample shown in FIG. 5*a*.

Figure 6A:
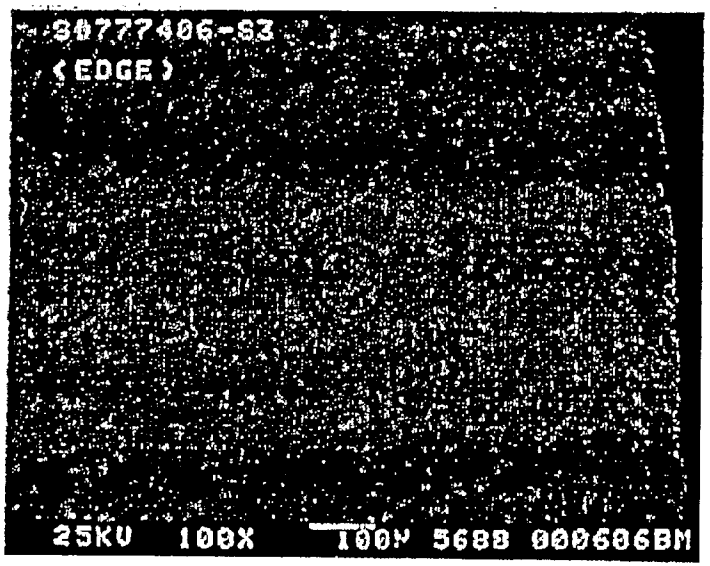
FIGS. 6*a* and 6*b* are micrographs of portions of a sintered cermet inert anode made by a spray drying process of the present invention.
Figure 6B:
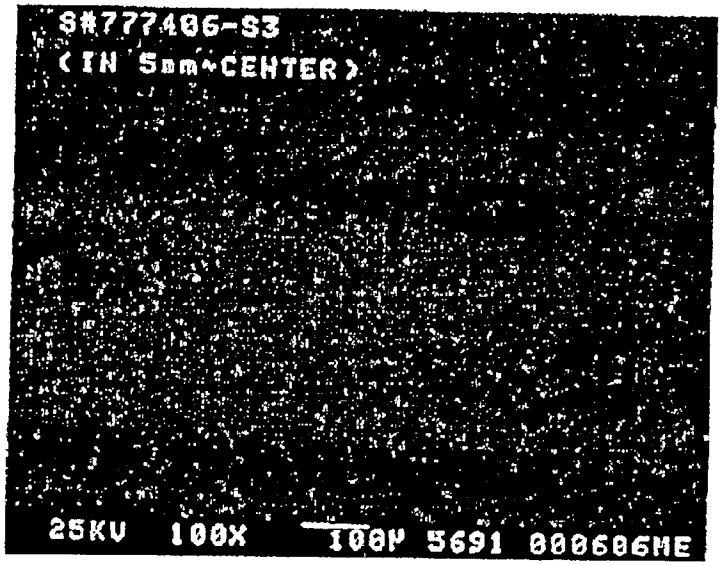

The spray dried powder shown in FIGS. 4*a* and 4*b* was pressed and sintered to form a cylindrical rod having a diameter of about 0.5 inch and a length of about 1 inch. The spray dried powder was isostatically pressed at a pressure of 20,000 psi, and then fired at a temperature of 1,330° C. for 4 hours. The sintered rod was cross-sectioned and studied under a microscope. FIG. 6*a* is a micrograph near the edge of the sectioned rod, while FIG. 6*b* is a micrograph near the center of the rod. As shown in FIGS. 6*a* and 6*b*, the spray dried cermet inert anode exhibits a more uniform microstructure and less porosity. The average porosity of the sample shown in FIGS. 6*a* and 6*b* is 0.18 percent, with an average pore diameter of 3.38 microns (0.6 standard deviation).

For comparison purposes, a dry-blended (non-spray dried) inert anode rod was made and compared with a spray dried cermet inert anode rod of the present invention. FIG. 7*a* is a micrograph of the dry-blended anode, which was made by combining 14 weight percent Cu and 2 weight percent $Ag_2O$ with spray dried Ni ferrite oxide powder, followed by pressing and sintering as described above. The average porosity of the sample shown in FIG. 7*a* is 1.44 percent, with an average pore diameter of 9.76 micron (3.68 standard deviation).

Figure 7B:
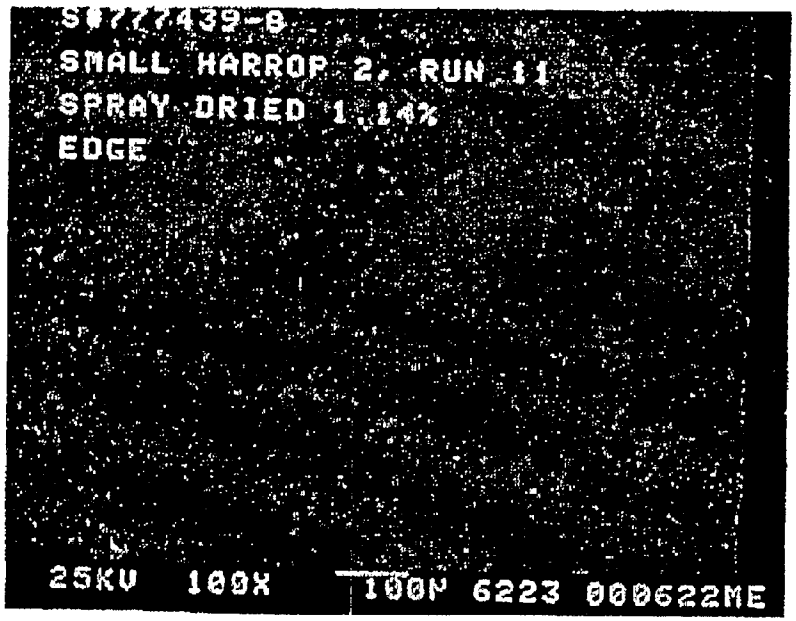
FIG. 7*b* is a micrograph of a sintered cermet inert anode produced from spray dried powders in accordance with an embodiment of the present invention.
Figure 7A:
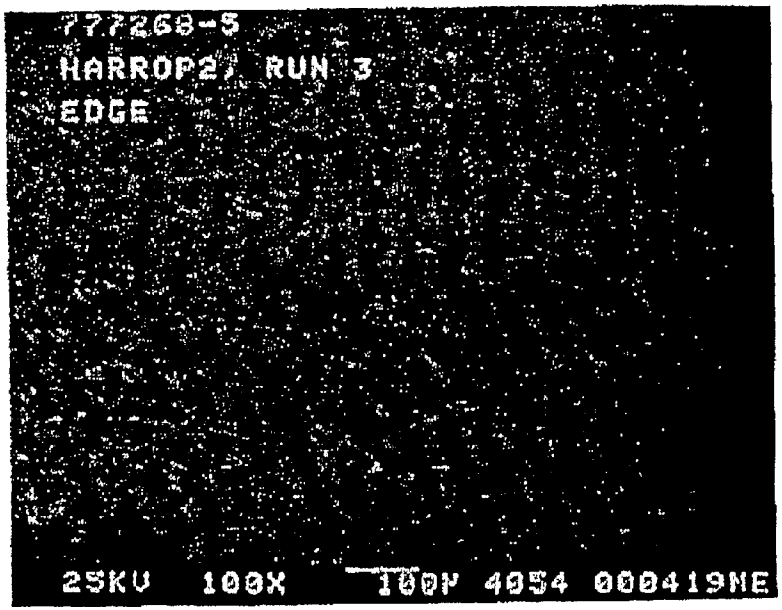
FIG. 7*a* is a micrograph of a sintered cermet inert anode produced from dry-blended ceramic and metal powders, without the spray drying process of the present invention.

FIG. 7*b* is a micrograph of a spray dried cermet inert anode rod made in accordance with the present invention. The sample shown in FIG. 7*b* was made from the same Cu, $Ag_2O$ and Ni ferrite oxide starting powders as the sample shown in FIG. 7*a*, except the starting powders were spray dried together in accordance with the present invention. By comparing FIGS. 7*a* and 7*b*, it can be seen that the spray dried cermet inert anode of the present invention has a more uniform microstructure and less porosity.

Porosity measurements for the dry-blended, pressed and sintered sample shown in FIG. 7*a*, versus the spray dried, pressed and sintered sample of the present invention shown in FIG. 6*a*, reveal an almost ten-fold decrease in average porosity and an almost three-fold reduction in average pore size for the sample of the present invention.

Mechanical properties of spray dried versus dry-blended cermet samples were tested using standard four point flexural strength test procedures. The results are shown in Table 8.

TABLE 8

Four Point Flexural Strength

| Sample No. | Position | Preparation | Strength, psi | Weibull m |
|---|---|---|---|---|
| 777331 | Wall | Dry-Blended | 17,275 | 8.9 |
| 777440 | Wall | Spray Dried | 18,502 | 11.0 |

As shown in Table 8, the strength of the spray dried cermet sample is higher than the strength of the dry-blended cermet sample. Furthermore, the Weibull modulus of the spray dried cermet sample is increased. The Weibull modulus can be described as the width of the failure stress distribution, or the homogeneity of the flaws within the material, with a large modulus corresponding to a small distribution width. As shown in Table 8, the spray dried cermet sample exhibits a larger Weibull modulus, and thus more homogeneous flaws, in comparison with the dry-blended cermet sample.

Inert anodes made of the present cermet materials may comprise a monolithic component of such cermet materials. Alternatively, the inert anode may comprise a substrate having at least one coating or outer layer of the present cermet material, or may comprise a core of the present cermet material coated with a material of different composition, such as a ceramic which does not include a metal phase or which includes a reduced amount of a metal phase.

The inert anode may be connected to a suitable electrically conductive support member within an electrolytic metal production cell by means such as welding, diffusion welding, brazing, mechanical fastening, cementing and the like. For example, the inert anode may include a cermet as described above successively connected in series to a transition region of higher metal content, and to a metal or metal alloy end such as nickel or Inconel. A nickel or nickel-chromium alloy rod may be welded to the metal end. The transition region, for example, may include four layers of graded composition, ranging from 25 weight percent Ni adjacent the cermet end and then 50, 75 and 100 weight percent Ni, balance the mixture of oxide and metal powders described above.

The present inert anodes are particularly useful in electrolytic cells for aluminum production operated at temperatures in the range of about 800° to 1,000° C. A particularly preferred cell operates at a temperature of about 900° to 980° C., preferably about 930° to 970° C. An electric current is passed between the inert anode and a cathode through a molten salt bath comprising an electrolyte and an oxide of the metal to be collected. In a preferred cell for aluminum production, the electrolyte comprises aluminum fluoride and sodium fluoride and the metal oxide is alumina. The weight ratio of sodium fluoride to aluminum fluoride is about 0.7 to 1.25, preferably about 1.0 to 1.20. The electrolyte may also contain calcium fluoride, lithium fluoride and/or magnesium fluoride.

The present inert anode materials may be used to produce commercial purity aluminum. The term "commercial purity aluminum" as used herein means aluminum which meets commercial purity standards upon production by an electrolytic reduction process. The commercial purity aluminum produced with the cermet inert anodes of the present invention preferably comprises a maximum of 0.2 weight percent Fe, 0.1 weight percent Cu, and 0.034 weight percent Ni. In a more preferred embodiment, the commercial purity aluminum comprises a maximum of 0.15 weight percent Fe, 0.034 weight percent Cu, and 0.03 weight percent Ni. In a particularly preferred embodiment, the commercial purity aluminum comprises a maximum of 0.13 weight percent Fe, 0.03 weight percent Cu, and 0.03 weight percent Ni. The commercial purity aluminum also preferably meets the following weight percent standards for other types of impurities: 0.2 maximum Si, 0.03 maximum Zn, and 0.034 maximum Co. The Zn and Co impurity levels are more preferably kept below 0.03 weight percent for each impurity. The Si impurity level is more preferably kept below 0.15 or 0.10 weight percent.

The ability of the present cermet inert anode compositions to produce high purity aluminum was evaluated in a series of pencil tests. Several test samples were prepared from the cermet compositions having diameters of about ⅝ inch and lengths of about 5 inches. The test samples were evaluated in a Hall-Heroult test cell. The cell was operated for several hours at 960° C., with an aluminum fluoride to sodium fluoride bath ratio of about 1:1 and an alumina concentration maintained at about 7–7.5 weight percent. The anode sample numbers and impurity concentrations in aluminum produced by the cell are shown in Table 9. The impurity values shown in Table 9 represent the average of four test samples of the produced metal taken at four different locations after the test period. Interim samples of the produced aluminum were consistently below the final impurity levels listed.

TABLE 9

Pencil Test Results

| Sample No. | Test Duration (hrs.) | Analyses of Metal Produced (wt %) Fe | Cu | Ni | Binder/ Plasticizer | Total Organic (wt %) |
|---|---|---|---|---|---|---|
| 777403 | 72 | 0.072 | 0.013 | 0.034 | 10 | 1.53 |
| 777403 | 100 | 0.26 | 0.19 | 0.28 | 10 | 1.53 |
| 777404 | 91 | 0.14 | 0.03 | 0.04 | 10 | 1.73 |
| 777404 | 100 | 0.16 | 0.055 | 0.085 | 10 | 1.73 |
| 777405 | 100 | 0.14 | 0.012 | 0.027 | 6 | 1.73 |
| 777406 | 100 | 0.054 | 0.007 | 0.016 | 3 | 1.73 |
| 777407 | 72 | 0.18 | 0.026 | 0.033 | 6 | 2.17 |
| 777408 | 79 | 0.11 | 0.017 | 0.017 | 6 | 1.14 |
| 777408 | 91 | 0.089 | 0.016 | 0.13 | 6 | 1.14 |

The cermet materials of the present invention are thus capable of being used in inert anodes for the production of commercial purity aluminum. The cermet materials also possess advantageous characteristics such as reduced porosity and improved mechanical properties.

Having described the presently preferred embodiments, it is to be understood that the invention may be otherwise embodied within the scope of the appended claims.

What is claimed is:

1. A method of making a cermet inert anode composition, the method comprising:

providing a slurry comprising ceramic phase particles and metal phase particles;

spray drying the slurry to form agglomerated particles comprising the ceramic phase and metal phase particles; and consolidating the spray dried particles to form a cermet inert anode composition comprising the ceramic phase and the metal phase.

2. The method of claim 1, wherein the ceramic phase comprises an oxide of Ni, Fe and at least one additional metal selected from Zn, Co, Al, Li, Cu, Ti, V, Cr, Zr, Nb, Ta, W, Mo, Hf and rare earths.

3. The method of claim 2, wherein at least one additional metal of the oxide phase is Zn, Co and/or Al.

4. The method of claim 1, wherein the ceramic phase comprises nickel, iron and zinc oxide.

5. The method of claim 4, wherein the composition of the ceramic phase corresponds to the following mole fractions of NiO, $Fe_2O_3$ and ZnO: 0.2 to 0.99 NiO; 0.0001 to 0.8 $Fe_2O_3$; and 0.0001 to 0.3 ZnO.

6. The method of claim 5, wherein the mole fraction of NiO is from 0.45 to 0.8, the mole fraction of $Fe_2O_3$ is from 0.05 to 0.499, and the mole fraction of ZnO is from 0.001 to 0.26.

7. The method of claim 5, wherein the mole fraction of NiO is from 0.45 to 0.65, the mole fraction of $Fe_2O_3$ is from 0.2 to 0.49, and the mole fraction of ZnO is from 0.001 to 0.22.

8. The method of claim 1, wherein the ceramic phase comprises nickel, iron and cobalt oxide.

9. The method of claim 8, wherein the composition of the ceramic phase corresponds to the following mole fractions of NiO, $Fe_2O_3$ and CoO: 0.15 to 0.99 NiO; 0.0001 to 0.85 to $Fe_2O_3$; and 0.0001 to 0.45 CoO.

10. The method of claim 9, wherein the mole fraction of NiO is from 0.15 to 0.6, the mole fraction of $Fe_2O_3$ is from 0.4 to 0.6, and the mole fraction of CoO is from 0.001 to 0.25.

11. The method of claim 9, wherein the mole fraction of NiO is from 0.25 to 0.55, the mole fraction of $Fe_2O_3$ is from 0.45 to 0.55, and the mole fraction of CoO is from 0.001 to 0.2.

12. The method of claim 1, wherein the metal phase comprises at least one metal selected from Cu, Ag, Pd, Pt, Au, Rh, Ru, Ir and Os.

13. The method of claim 1, wherein the metal phase comprises at least one base metal selected from the group consisting of Cu and Ag, and at least one noble metal selected from the group consisting of Ag, Pd, Pt, Au, Rh, Ru, Ir and Os.

14. The method of claim 13, wherein the base metal comprises Cu, and the at least one noble metal comprises Ag, Pd, Pt, Au, Rh or a combination thereof.

15. The method of claim 1, wherein the ceramic phase comprises an oxide of Ni, Fe and at least an additional metal selected from Zn and Co, and the metal phase comprises at least one metal selected from Cu, Ag, Pd, Pt, Au, Rh, Ru, Ir and Os.

16. The method of claim 15, wherein the ceramic phase comprises an oxide of Ni, Fe and Zn.

17. The method of claim 16, wherein the metal phase comprises Cu and/or Ag.

18. The method of claim 1, wherein the composition comprises from about 1 to about 99.9 weight percent of the ceramic phase and from about 0.1 to about 99 weight percent of the metal phase.

19. The method of claim 1, wherein the composition comprises from about 50 to about 95 weight percent of the ceramic phase and from about 5 to about 50 weight percent of the metal phase.

20. The method of claim 1, wherein the spray dried particles have average particle sizes of from about 40 to about 400 microns.

21. The method of claim 1, wherein the ceramic phase particles and metal phase particles have average particle sizes at least 4 times less than an average particle size of the spray dried particles.

22. The method of claim 1, wherein the ceramic phase particles have an average particle size less than an average particles size of the metal phase particles.

23. The method of claim 1, wherein the ceramic phase particles have an average particle size of from about 0.1 to about 1 micron.

24. The method of claim 1, wherein the metal phase particles have an average particle size of from about 0.1 to about 20 microns.

25. The method of claim 1, further comprising the steps of spray drying and calcining oxide starting materials to form the ceramic phase particles prior to the step of providing the slurry.

26. The method of claim 25, wherein the oxide starting materials comprise NiO and/or $Fe_2O_3$.

27. The method of claim 25, further comprising the step of grinding the spray dried and calcined oxide starting materials prior to the step of providing the slurry.

28. The method of claim 1, wherein the spray dried particles are consolidated by pressing and sintering the ceramic and metal mixture.

29. The method of claim 1, further comprising connecting the cermet inert anode composition to an electrical connector.

30. A cermet inert anode composition comprising consolidated spray dried particles including ceramic and metal phases.

31. The cermet inert anode composition of claim 30, wherein the ceramic phase comprises an oxide of Ni, Fe and at least one additional metal selected from Zn, Co, Al, Li, Cu, Ti, V, Cr, Zr, Nb, Ta, W, Mo, Hf and rare earths.

32. The cermet inert anode composition of claim 30, wherein the composition of the ceramic phase corresponds to the following mole fractions of NiO, $Fe_2O_3$ and ZnO: 0.2 to 0.99 NiO; 0.0001 to 0.8 $Fe_2O_3$; and 0.0001 to 0.3 ZnO.

33. The cermet inert anode composition of claim 30, wherein the composition of the ceramic phase corresponds to the following mole fractions of NiO, $Fe_2O_3$ and CoO: 0.15 to 0.99 NiO; 0.0001 to 0.85 to $Fe_2O_3$; and 0.0001 to 0.45 CoO.

34. The cermet inert anode composition of claim 30, wherein the metal phase comprises at least one metal selected from Cu, Ag, Pd, Pt, Au, Rh, Ru, Ir and Os.

35. The cermet inert anode composition of claim 30, wherein the composition comprises from about 50 to about 95 weight percent of the ceramic phase and from about 5 to about 50 weight percent of the metal phase.

36. A method of making a composite powder, the method comprising:

providing a slurry comprising ceramic phase particles and metal phase particles, wherein the ceramic phase comprises an oxide of Ni and/or Fe; and spray drying the slurry to form a powder including agglomerated particles comprising the ceramic phase and metal phase particles.

37. The method of claim 36, wherein the composition of the ceramic phase corresponds to the following mole fractions of NiO, $Fe_2O_3$ and ZnO: 0.2 to 0.99 NiO; 0.0001 to 0.8 $Fe_2O_3$; and 0.0001 to 0.3 ZnO.

38. The method of claim 36, wherein the composition of the ceramic phase corresponds to the following mole fractions of NiO, $Fe_2O_3$ and CoO: 0.15 to 0.99 NiO; 0.0001 to 0.85 to $Fe_2O_3$; and 0.0001 to 0.45 CoO.

39. The method of claim 36, wherein the metal phase comprises at least one metal selected from Cu, Ag, Pd, Pt, Au, Rh, Ru, Ir and Os.

40. The method of claim 36, wherein the composition comprises from about 50 to about 95 weight percent of the ceramic phase and from about 5 to about 50 weight percent of the metal phase.

41. The method of claim 36, wherein the spray dried particles have average particle sizes of from about 40 to about 400 microns.

42. The method of claim 36, wherein the ceramic phase particles and metal phase particles have average particle sizes at least 4 times less than an average particle size of the spray dried particles.

43. A composite powder comprising spray dried particles including ceramic phase and metal phase particles.

44. The composite powder of claim 43, wherein the ceramic phase comprises an oxide of Ni, Fe and at least one additional metal selected from Zn, Co, Al, Li, Cu, Ti, V, Cr, Zr, Nb, Ta, W, Mo, Hf and rare earths.

45. The composite powder of claim 43, wherein the composition of the ceramic phase corresponds to the following mole fractions of NiO, $Fe_2O_3$ and ZnO: 0.2 to 0.99 NiO; 0.0001 to 0.8 $Fe_2O_3$; and 0.0001 to 0.3 ZnO.

46. The composite powder of claim 43, wherein the composition of the ceramic phase corresponds to the following mole fractions of NiO, $Fe_2O_3$ and CoO: 0.15 to 0.99 NiO; 0.0001 to 0.85 to $Fe_2O_3$; and 0.0001 to 0.45 CoO.

47. The composite powder of claim 43, wherein the metal phase comprises at least one metal selected from Cu, Ag, Pd, Pt, Au, Rh, Ru, Ir and Os.

48. The composite powder of claim 43, wherein the composition comprises from about 50 to about 95 weight percent of the ceramic phase and from about 5 to about 50 weight percent of the metal phase.

49. The composite powder of claim 43, wherein the spray dried particles have average particle sizes of from about 40 to about 400 microns.

50. The composite powder of claim 43, wherein the ceramic phase particles and metal phase particles have average particle sizes at least 4 times less than an average particle size of the spray dried particles.

51. The composite powder of claim 43, wherein the ceramic phase particles have an average particle size less than an average particles size of the metal phase particles.

52. The composite powder of claim 43, wherein the ceramic phase particles have an average particle size of from about 0.1 to about 1 micron.

53. The composite powder of claim 43, wherein the metal phase particles have an average particle size of from about 0.1 to about 20 microns.

54. A method of making a green compact of ceramic and metal phase particles, the method comprising:

providing a slurry comprising ceramic phase particles and metal phase particles, wherein the ceramic phase comprises an oxide of Ni and/or Fe;

spray drying the slurry to form agglomerated particles comprising the ceramic phase and metal phase particles; and pressing the spray dried particles to form the green compact.

55. The method of claim 54, wherein the composition of the ceramic phase corresponds to the following mole fractions of NiO, $Fe_2O_3$ and ZnO: 0.2 to 0.99 NiO; 0.0001 to 0.8 $Fe_2O_3$; and 0.0001 to 0.3 ZnO.

56. The method of claim 54, wherein the composition of the ceramic phase corresponds to the following mole fractions of NiO, $Fe_2O_3$ and CoO: 0.15 to 0.99 NiO; 0.0001 to 0.85 to $Fe_2O_3$; and 0.0001 to 0.45 CoO.

57. The method of claim 54, wherein the metal phase comprises at least one metal selected from Cu, Ag, Pd, Pt, Au, Rh, Ru, Ir and Os.

58. A green compact of ceramic phase and metal phase particles comprising pressed spray dried particles including the ceramic phase and metal phase particles.

59. The green compact of claim 58, wherein the ceramic phase comprises an oxide of Ni, Fe and at least one additional metal selected from Zn, Co, Al, Li, Cu, Ti, V, Cr, Zr, Nb, Ta, W, Mo, Hf and rare earths.

60. The green compact of claim 58, wherein the composition of the ceramic phase corresponds to the following mole fractions of NiO, $Fe_2O_3$ and ZnO: 0.2 to 0.99 NiO; 0.0001 to 0.8 $Fe_2O_3$; and 0.0001 to 0.3 ZnO.

61. The green compact of claim 58, wherein the composition of the ceramic phase corresponds to the following mole fractions of NiO, $Fe_2O_3$ and CoO: 0.15 to 0.99 NiO; 0.0001 to 0.85 to $Fe_2O_3$; and 0.0001 to 0.45 CoO.

62. The green compact of claim 58, wherein the metal phase comprises at least one metal selected from Cu, Ag, Pd, Pt, Au, Rh, Ru, Ir and Os.

* * * * *